US012797703B2

(12) United States Patent
Cui

(10) Patent No.: US 12,797,703 B2
(45) Date of Patent: Nov. 17, 2026

(54) GOAL FRAME AND GOAL

(71) Applicant: SHENZHEN KEYINGSI TRADING CO., LTD., Shenzhen (CN)

(72) Inventor: Yong Cui, Shenzhen (CN)

(73) Assignee: SHENZHEN KEYINGSI TRADING CO., LTD., Shenzhen (CN)

( * ) Notice: Subject to any disclaimer, the term of this patent is extended or adjusted under 35 U.S.C. 154(b) by 394 days.

(21) Appl. No.: 18/406,311

(22) Filed: Jan. 8, 2024

(65) Prior Publication Data

US 2025/0195973 A1 Jun. 19, 2025

(30) Foreign Application Priority Data

Dec. 15, 2023 (CN) ..... 202323438633.4

(51) Int. Cl.
*A63B 63/00* (2006.01)

(52) U.S. Cl.
CPC ..... *A63B 63/004* (2013.01); *A63B 2210/50* (2013.01)

(58) Field of Classification Search
None
See application file for complete search history.

(56) References Cited

U.S. PATENT DOCUMENTS

2003/0153412 A1* 8/2003 Duba ..... A63B 63/004 473/478
2012/0100940 A1* 4/2012 Hajarian ..... A63B 63/004 473/476
2017/0095716 A1* 4/2017 Lewis ..... A63B 63/004

FOREIGN PATENT DOCUMENTS

JP 2002126145 A * 5/2002

* cited by examiner

*Primary Examiner* — Eugene L Kim
*Assistant Examiner* — Samantha M Berry
(74) *Attorney, Agent, or Firm* — HOWARD M COHN and Associates, LLC

(57) ABSTRACT

The present disclosure provides a goal frame and a goal, the goal frame includes connecting rods and movable corner joints, adjacent two of the connecting rods are movably connected through a corresponding one of the movable corner joints, the connecting rods are connected end to end through the movable corner joints to form the goal frame, each of the movable corner joints includes a first housing and a second housing connected to each other, the first housing is rotatable with respect to the second housing within a predetermined angle range, the connecting rods includes first connecting rods and second connecting rods adjacent to each other, an end of each of the first connecting rods is connected to a corresponding first housing, and an end of each of the second connecting rods close to a corresponding first connecting rod is connected to a corresponding second housing.

9 Claims, 11 Drawing Sheets

GOAL FRAME AND GOAL

TECHNICAL FIELD

The present disclosure relates to a field of sports equipment, in particular to a goal frame and a goal.

BACKGROUND

Since living standards of people are increasingly improved, outdoor ball sports are favored by the people, a goal is an indispensable configuration for the outdoor ball sports, which generally needs to be carried outside and then installed or disassembled after arriving at a designated location.

However, most of current outdoor portable goals are only capable of being folded in a single direction, for example, a goal frame of a goal is folded in half from the single direction. The goal is folded but still occupies a relatively large area and is inconvenient to carry, moreover, after being folded, since the goal frame has a large toughness and may generate a resilience recovery force, the goal frame is difficult to stabilize in a folded state, that is, the goal frame could unfold at any time, which is not easy to store. A whole process of folding and storing the goal is achieved through manual operation, which is difficult to operate and reduces user experience.

Therefore, how to fold and unfold the goal frame from different directions, reduce difficulty of operation, improve the user experience, and facilitate storage and use of the goal frame has become an urgent problem to be solved in the field.

SUMMARY

The present disclosure is to provide a goal frame and a goal, and aims to fold and unfold the goal frame from different directions, so as to facilitate storage and use of the goal frame.

The present disclosure provides the goal frame, including connecting rods and movable corner joints, adjacent two of the connecting rods are movably connected through a corresponding one of the movable corner joints, and the connecting rods are connected end to end through the movable corner joints to form the goal frame, each of the movable corner joints includes a first housing and a second housing connected to each other, the first housing is rotatable with respect to the second housing within a predetermined angle range, and a connection direction of each adjacent two of the connecting rods is different, the connecting rods includes first connecting rods and second connecting rods adjacent to each other, an end of each of the first connecting rods is connected to a corresponding first housing, and an end of each of the second connecting rods close to a corresponding first connecting rod is connected to a corresponding second housing, the first housing rotates to drive one of the first connecting rods to rotate, so that the goal frame is switched between a first state and a second state.

Optionally, the first housing and the second housing each includes a first connecting member and a second connecting member, a first end of the first connecting member is connected to the second connecting member, and a second end of the first connecting member distal from the second connecting member defines an opening, a rotating shaft is disposed in a middle portion of the second connecting member of the first housing, the second connecting member of the second housing defines a rotating shaft hole at a position corresponding to the rotating shaft, the rotating shaft is inserted into the rotating shaft hole, so that the second connecting member of the first housing is connected to the second connecting member of the second housing.

Optionally, a first limiting member is disposed on the second connecting member of the first housing, a second limiting member is disposed at a position of the second connecting member of the second housing corresponding to the first limiting member, and the first limiting member is movably connected to the second limiting member, the second limiting member includes a first limiting end and a second limiting end, when the first housing rotates to be in the first state with respect to the second housing, the first limiting member abuts against the first limiting end, and when the first housing rotates to be in the second state with respect to the second housing, the first limiting member abuts against the second limiting end.

Optionally, the first connecting member of the first housing and the first connecting member of the second housing are both in tubular shapes, the second connecting member of the first housing and the second connecting member of the second housing are both cylindrical housing structures, the second connecting member of the first housing is embedded in the second connecting member of the second housing, and a side wall of the second connecting member of the first housing abuts against a side wall of the second connecting member of the second housing, a limiting post is disposed at a position on the second connecting member of the second housing corresponding to the rotating shaft hole, the limiting post is a hollow structure, and two ends of the limiting post respectively define two first openings, the first openings correspond to the rotating shaft hole, and the rotating shaft passes through the rotating shaft hole and extends into the limiting post, a torsion spring is sleeved on an outer side of the limiting post, the torsion spring includes a first end and a second end, the first end of the torsion spring is connected to the second connecting member of the first housing, and the second end of the torsion spring is connected to the second connecting member of the second housing, the first limiting member includes a first limiting plate disposed on the second connecting member of the first housing, the second limiting member includes a limiting housing disposed in the second connecting member of the second housing, the first limiting end is a second limiting plate disposed in the limiting housing, and the second limiting end is a third limiting plate disposed in the limiting housing, when the goal frame is switched from the second state to the first state, an external force is applied to the first housing to drive the first housing to rotate with respect to the second housing, the torsion spring is compressed, and the first limiting plate abuts against the second limiting plate, when the external force disappears, the torsion spring relaxes under an elastic force and drives the first housing to rotate with respect to the second housing, and the first limiting plate abuts against the third limiting plate, so that the goal frame is automatically switched from the first state to the second state.

A buffer layer is filled between the limiting post and the rotating shaft, the buffer layer is made of a damping material, and the buffer layer is configured to buffer the elastic force of the torsion spring.

Optionally, the first connecting rods include a first transverse rod, a third supporting rod, and a fourth supporting rod, and the second connecting rods include a second transverse rod, a first supporting rod, and a second supporting rod, two ends of the first transverse rod are respectively connected to an end of the first supporting rod and an end of the second supporting rod, an end of the first supporting rod distal from the first transverse rod is connected to an end of the third supporting rod, an end of the second supporting rod distal from the first transverse rod is connected to an end of the fourth supporting rod, and an end of the third supporting rod distal from the first supporting rod and an end of the fourth supporting rod distal from the second supporting rod are respectively connected to the second transverse rod, the movable corner joints include a first movable corner joint, a second movable corner joint, a third movable corner joint, a fourth movable corner joint, a fifth movable corner joint, and a sixth movable corner joint, the first movable corner joint is connected between ends of the first transverse rod and the first supporting rod, the second movable corner joint is connected between ends of the first transverse rod and the second supporting rod, the third movable corner joint is connected between ends of the first supporting rod and the third supporting rod, the fourth movable corner joint is connected between ends of the second supporting rod and the fourth supporting rod, the fifth movable corner joint is connected between ends of the second transverse rod and the third supporting rod, and the sixth movable corner joint is connected between ends of the second transverse rod and the fourth supporting rod, the first movable corner joint between the first transverse rod and the first supporting rod and the second movable corner joint between the first transverse rod and the second supporting rod respectively drive the first supporting rod and the second supporting rod to rotate toward a direction of the first transverse rod, and the first supporting rod and the second supporting rod are respectively folded with respect to the first transverse rod, the third movable corner joint between the first supporting rod and the third supporting rod drives the third supporting rod to rotate toward a direction of the first supporting rod, and the third supporting rod is folded with respect to the first supporting rod, the fourth movable corner joint between the second supporting rod and the fourth supporting rod drives the fourth supporting rod to rotate toward a direction of the second supporting rod, and the fourth supporting rod is folded with respect to the second supporting rod, the fifth movable corner joint between the second transverse rod and the third supporting rod and the sixth movable corner joint between the second transverse rod and the fourth supporting rod respectively drive the third supporting rod and the fourth supporting rod to rotate toward a direction of the second transverse, and the third supporting rod and the fourth supporting rod are respectively folded with respect to the second transverse rod.

Optionally, the first transverse rod, the second transverse rod, the first supporting rod, the second supporting rod, the third supporting rod, and the fourth supporting rod each includes a first rod and a second rod, and the first rod and the second rod are both hollow structures, the first rod includes a first telescopic end and a first connecting end, the second end includes a second telescopic end and a second connecting end, the first telescopic end is close to the second telescopic end, and the first connecting end is distal from the second connecting end, the first connecting end and the second connecting end are respectively connected to corresponding movable corner joints, the first telescopic end is nested in the second rod and extends and retracts along a length direction of the second rod, a limiting protrusion is disposed on the first telescopic end, the second telescopic end defines a limiting groove at a position corresponding to the limiting protrusion, and the limiting protrusion is embedded in the limiting groove Optionally, an end of each first rod is connected to a corresponding first housing of one of the movable corner joints, and the second rod is connected to a corresponding second housing of an adjacent one of the movable corner joints, an outer surface of the first rod defines first fixing grooves, the first fixing grooves are defined at intervals around the outer surface of the first rod, and an extending direction of each first fixing groove is the same as an extending direction of the first rod, at least one first fixing protruding strip is disposed on the first connecting member of the first housing, each first fixing protruding strip is disposed corresponding to one of the first fixing grooves, an extending direction of each first fixing protruding strip is the same as an extending direction of the first connecting member of the first housing, and each first fixing protruding strip is embedded in one of the first fixing grooves, an outer surface of the second rod defines second fixing grooves, the second fixing grooves are defined at intervals around the outer surface of the second rod, and an extending direction of each second fixing groove is the same as an extending direction of the second rod, at least one second fixing protruding strip is disposed on the first connecting member of the second housing, each second fixing protruding strip is disposed corresponding to one of the second fixing grooves, an extending direction of each second fixing protruding strip is the same as an extending direction of the first connecting member of the second housing, and the each second fixing protruding strip is embedded in one of the second fixing grooves, positions of the first fixing grooves are in one-to-one correspondence with positions of the second fixing grooves, and a width of each of the first fixing grooves is greater than a width of a corresponding second fixing groove.

Optionally, reinforcing ribs are further disposed in the first connecting member of the first housing, the reinforcing ribs are disposed along a circumferential direction of the first connecting member of the first housing, so that an inner diameter of the first connecting member of the first housing is smaller than an inner diameter of the first connecting member of the second housing The present disclosure further provides a goal, including a ball net and the above-mentioned goal frame, the goal frame is connected to the ball net.

In the present disclosure, the movable corner joints are disposed between the connecting rods, and the connecting rods connected end to end are rotatably connected by using the movable corner joints, each of the movable corner joint forms a similar joint structure between adjacent two of the connecting rods. The first housing of each of the movable corner joints is connected to a corresponding first connecting rod, and the second housing of each of the movable corner joints is connected to a corresponding second connecting rod, so that when the first housing rotates with respect to the second housing, the corresponding first connecting rod and the corresponding second connecting rod are driven to rotate within the predetermined angle range, so that the connecting rods connected in different directions of the goal frame may be freely folded, in this way, the goal frame is quickly folded from multiple directions, which effectively reduces an occupied area after the goal frame is folded, facilitates storage and use of the goal frame, and improves portability of the goal.

BRIEF DESCRIPTION OF DRAWINGS

Accompanying drawings are used to provide a further understanding of embodiments of the present disclosure, which constitute a part of this specification, drawings are used to illustrate the embodiments of the present disclosure and explain principles of the present disclosure together with text description. Obviously, the drawings in following description are merely some embodiments of the present disclosure, for those of ordinary skill in the art, other drawings may be obtained according to these drawings without creative efforts, in the drawings.

DETAILED DESCRIPTION

Figure 1:
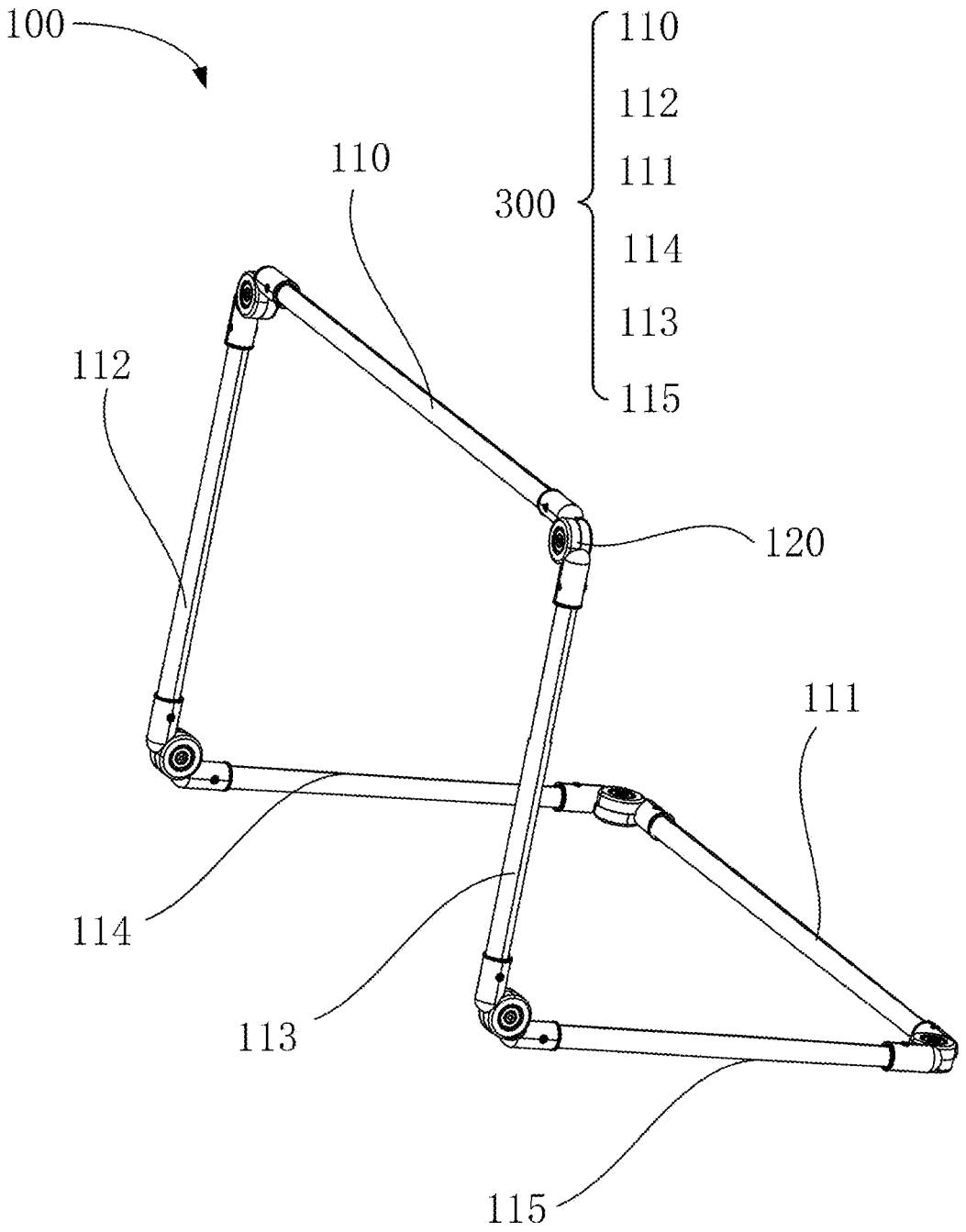
FIG. 1 is a schematic diagram of an unfolded state of a goal frame according to a first embodiment of the present disclosure.
Figure 2:
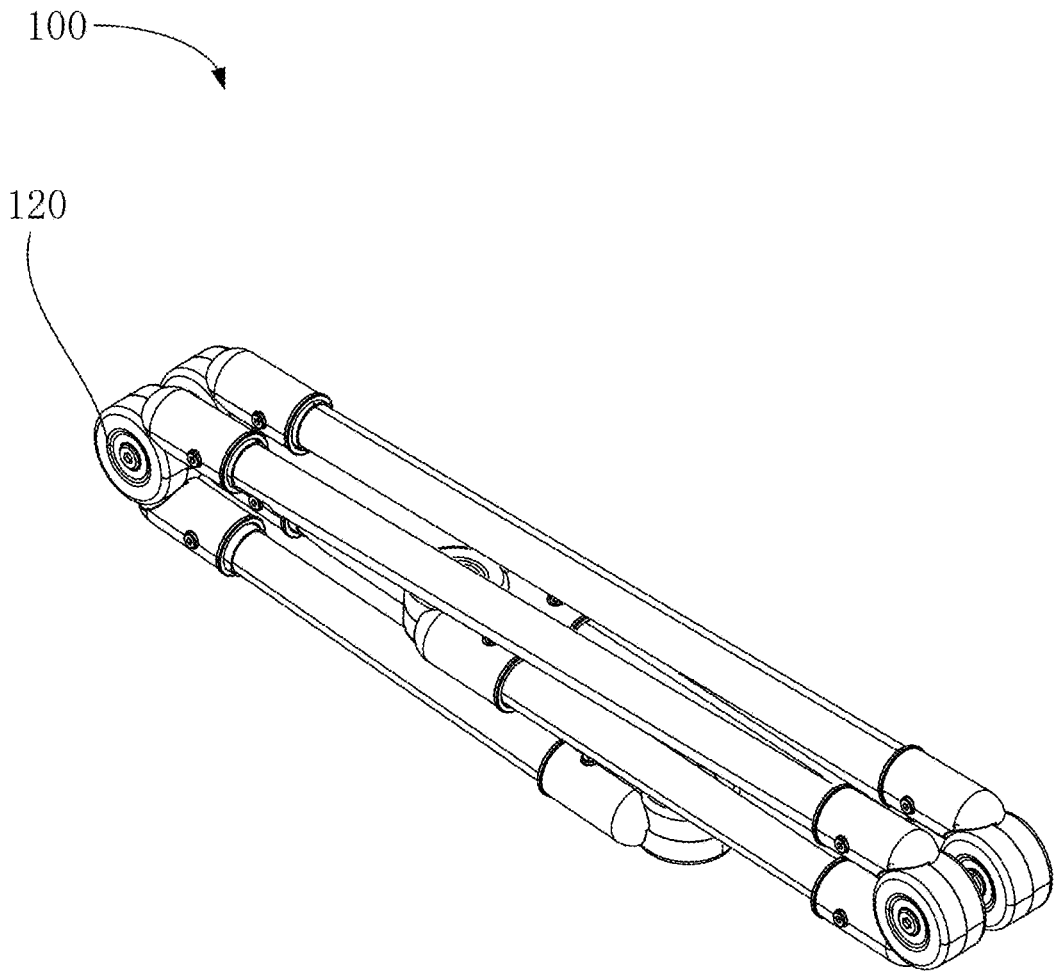
FIG. 2 is a schematic diagram of a folded state of the goal frame according to the first embodiment of the present disclosure.
Figure 3:
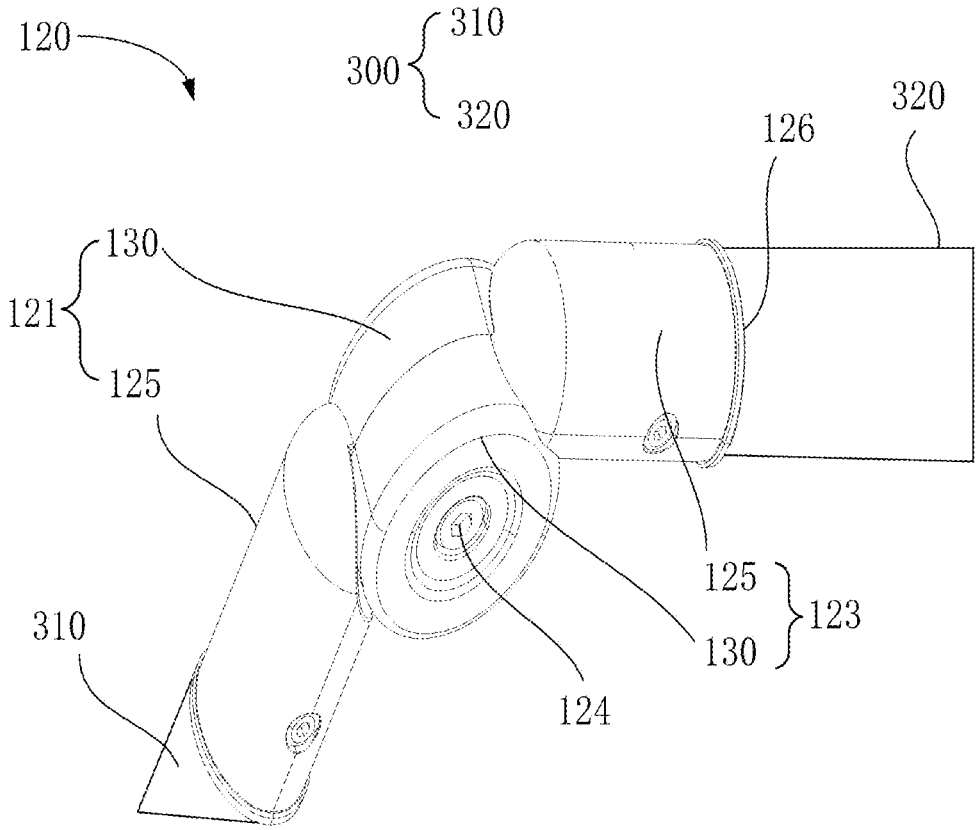
FIG. 3 is a schematic diagram of a movable corner joint of the goal frame according to the first embodiment of the present disclosure.
Figure 4:
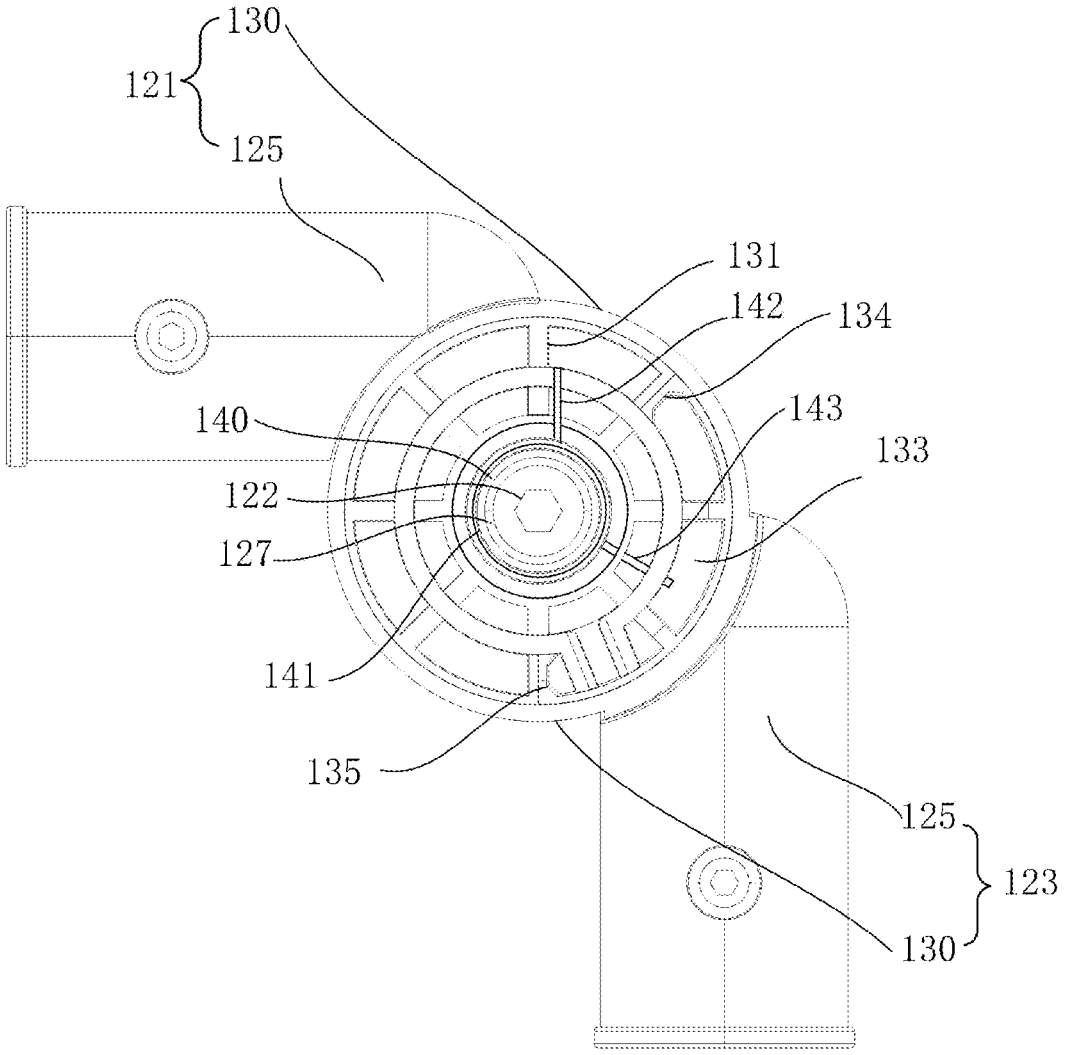
FIG. 4 is a schematic diagram of an internal structure of the movable corner joint of the goal frame according to the first embodiment of the present disclosure.

The present disclosure is described in detail below with reference to the accompanying drawings and Optionally embodiments, and it should be noted that, on the premise of no conflict, embodiments described below or technical features described below may be arbitrarily combined to form new embodiments FIG. 1 is a schematic diagram of an unfolded state of a goal frame according to a first embodiment of the present disclosure, FIG. 2 is a schematic diagram of a folded state of the goal frame according to the first embodiment of the present disclosure, FIG. 3 is a schematic diagram of a movable corner joint of the goal frame according to the first embodiment of the present disclosure, FIG. 4 is a schematic diagram of an internal structure of the movable corner joint of the goal frame according to the first embodiment of the present disclosure. As shown in FIG. 1 to FIG. 4, the present disclosure provides a goal frame 100, including connecting rods 300 and movable corner joints 120, adjacent two of the connecting rods 300 are movably connected through a corresponding one of the movable corner joints 120, and the connecting rods 300 are connected end to end through the movable corner joints 120 to form the goal frame 100. Each of the movable corner joints 120 includes a first housing 121 and a second housing 123 connected to each other, the first housing 121 is rotatable with respect to the second housing 123 within a predetermined angle range, and a connection direction of each adjacent two of the connecting rods 130 is different. The connecting rods 300 includes first connecting rods 310 and second connecting rods 320 adjacent to each other, an end of each of the first connecting rods 310 is connected to a corresponding first housing 121, and an end of each of the second connecting rods 320 close to a corresponding first connecting rod 310 is connected to a corresponding second housing 123. The first housing 121 rotates to drive one of the first connecting rods 310 to rotate, so that the goal frame 100 is switched between a first state and a second state In the present disclosure, the movable corner joints 120 are disposed between the connecting rods 300, and the connecting rods 300 connected end to end are rotatably connected by using the movable corner joints 120, each of the movable corner joints 120 forms a similar joint structure between the adjacent two of the connecting rods 300. The first housing 121 of each of the movable corner joints 120 is connected to a corresponding first connecting rod 310, and the second housing 123 of each of the movable corner joints 120 is connected to a corresponding second connecting rod 320. The goal frame 100 remains in the unfolded state without an external force. When the goal frame 100 needs to be stored, each first housing 121 rotates with respect to a corresponding second housing 123, the corresponding first connecting rod 310 and the corresponding second connecting rod 320 are driven to rotate within the predetermined angle range, so that each of the connecting rods 300 of the goal frame 100 may be freely folded, the goal frame 100 is quickly folded from multiple directions, an occupied area after the goal frame 100 is folded is effectively reduced, and then the goal frame 100 in the folded state may be fixed by using a tool, such as a strap, a storage bag, a hook and loop fastener, etc., which facilitates storage and use of the goal frame 100, and improves portability of the goal.

It should be noted that the first state in the present disclosure is the folded state, the second state is the unfolded state, specifically, the first state may be represented as being in the folded state between adjacent two of the connecting rods 300 or among the connecting rods 300, and the second state may be represented as being in the unfolded state between adjacent two of connecting rods 300 or among the connecting rods 300.

Specifically, as shown in FIG. 1, the first connecting rods 310 include a first transverse rod 110, a third supporting rod 114, and a fourth supporting rod 115, and the second connecting rods 320 include a second transverse rod 111, a first supporting rod 112, and a second supporting rod 113, the first transverse rod 110 and the second transverse rod 111 are disposed in parallel, the first supporting rod 112 and the second supporting rod 113 are disposed in parallel, the third supporting rod 114 and the fourth supporting rod 115 are disposed in parallel, the first supporting rod 112 is perpendicular to the third supporting rod 114, and the second supporting rod 113 is perpendicular to the fourth supporting rod 115. Two ends of the first transverse rod 110 are respectively connected to an end of the first supporting rod 112 and an end of the second supporting rod 113, an end of the first supporting rod 112 distal from the first transverse rod 110 is connected to an end of the third supporting rod 114, an end of the second supporting rod 113 distal from the first transverse rod 110 110 is connected to an end of the fourth supporting rod 115, and an end of the third supporting rod 114 distal from the first supporting rod 112 and an end of the fourth supporting rod 115 distal from the second supporting rod 113 are respectively connected to the second transverse rod 111, the movable corner joints 120 include a first movable corner joint, a second movable corner joint, a third movable corner joint, a fourth movable corner joint, a fifth movable corner joint, and a sixth movable corner joint. The first movable corner joint is connected between ends of the first transverse rod 110 and the first supporting rod 112, the second movable corner joint is connected between ends of the first transverse rod 110 and the second supporting rod 113, the third movable corner joint is connected between ends of the first supporting rod 112 and the third supporting rod 114, the fourth movable corner joint is connected between ends of the second supporting rod 113 and the fourth supporting rod 115, the fifth movable corner joint is connected between ends of the second transverse rod 111 and the third supporting rod 114, and the sixth movable corner joint is connected between ends of the second transverse rod 111 and the fourth supporting rod 115. The first movable corner joint between the first transverse rod 110 and the first supporting rod 112 and the second movable corner joint between the first transverse rod 110 and the second supporting rod 113 respectively drive the first supporting rod 112 and the second supporting rod 113 to rotate toward a direction of the first transverse rod 110, and the first supporting rod 112 and the second supporting rod 113 are respectively folded with respect to the first transverse rod 110. The third movable corner joint between the first supporting rod 112 and the third supporting rod 114 drives the third supporting rod 114 to rotate toward a direction of the first supporting rod 112, and the third supporting rod 114 is folded with respect to the first supporting rod 112. The fourth movable corner joint between the second supporting rod 113 and the fourth supporting rod 115 drives the fourth supporting rod 115 to rotate toward a direction of the second supporting rod 113, and the fourth supporting rod 115 is folded with respect to the second supporting rod 113. The fifth movable corner joint between the second transverse rod 111 and the third supporting rod 114 and the sixth movable corner joint between the second transverse rod 111 and the fourth supporting rod 115 respectively drive the third supporting rod 114 and the fourth supporting rod 115 to rotate toward a direction of the second transverse, and the third supporting rod 114 and the fourth supporting rod 115 are respectively folded with respect to the second transverse rod 111.

In the present disclosure, transverse rods include the first transverse rod 110 and the second transverse rod 111, and the supporting rods include the first supporting rod 112, the second supporting rod 113, the third supporting rod 114, and the fourth supporting rod 115. Corresponding movable corner joints 120 are disposed between each of the transverse rods and each of the supporting rods of the goal frame 100, each of the transverse rods and each of the supporting rods are rotatably connected through corresponding movable corner joints 120, the corresponding movable corner joints 120 form similar joint structures between each of the transverse rods and each of the supporting rods, so that each of the transverse rods and each of the supporting rods of the goal frame 100 are freely folded. When the goal frame 100 needs to be folded, the third movable corner joint between the first supporting rod 112 and the third supporting rod 114 and the fourth movable corner joint between the second supporting rod 113 and the fourth supporting rod 115 are first rotated, so that the first supporting rod 112 and the third supporting rod 114 are folded together, and the second supporting rod 113 and the fourth supporting rod 115 are folded together, so that the goal frame 100 is folded in a longitudinal direction, and a size of the goal frame 100 is reduced. And then, the first supporting rod 112 together with the third supporting rod 114, the second supporting rod 113 together with the fourth supporting rod 115 are rotated simultaneously by the first movable corner joint between the first supporting rod 112 and the first transverse rod 110, the second movable corner joint 120 between the second supporting rod 113 and the first transverse rod 110, the fifth movable corner joint between the third supporting rod 114 and the second transverse rod 111, and the sixth movable corner joint 120 between the fourth supporting rod 115 and the second transverse rod 111, so that the first supporting rod 112 and the second supporting rod 113 are folded together with the first transverse rod 110, and the third supporting rod 114 and the fourth supporting rod 115 are folded together with the second transverse rod 111, so that the goal frame 100 is folded again in a transverse direction, and the size of the goal frame 100 is reduced again, the goal frame 100 is integrally in a long strip shape, in this way, the goal frame 100 is quickly folded from multiple directions, the occupied area after the goal frame 100 is folded is effectively reduced, the goal frame 100 is convenient to store and use, and portability of the goal 10 is improved.

In the present disclosure, the predetermined angle range of rotation of the first housing 121 with respect to the second housing 123 may be between 0 degrees and 90 degrees, but is not limited to this range. By connecting adjacent two of the connecting rods 300, that is, an end of each of the first connecting rods 310 is connected to a corresponding first housing 121, and an end of each of the second connecting rods 320 is connected to a corresponding second housing 123, so that each first housing 121 and each second housing 123 drive the corresponding first connecting rod 310 and the corresponding second connecting rod 320 to rotate during a rotating process, so that the corresponding first connecting rod 310 and the corresponding second connecting rod 320 are switched between the first state and the second state.

Specifically, through the first movable corner joint disposed between the first transverse rod 110 and the first supporting rod 112, the first housing 121 is connected to the first transverse rod 110, and the second housing 123 is connected to the first supporting rod 112. Through the second movable corner joint disposed between the first transverse rod 110 and the second supporting rod 113, the first housing 121 is connected to the first transverse rod 110, and the second housing 123 is connected to the second supporting rod 113. Through the third movable corner joint disposed between the first supporting rod 112 and the third supporting rod 114, the first housing 121 is connected to the first supporting rod 112, and the second housing 123 is connected to the third supporting rod 114. Through the fourth movable corner joint disposed between the second supporting rod 113 and the fourth supporting rod 115, the first housing 121 is connected to the second supporting rod 113, and the second housing 123 is connected to the fourth supporting rod 115. Through the fifth movable corner joint disposed between the third supporting rod 114 and the second transverse rod 111, the first housing 121 is connected to the third supporting rod 114, and the second housing 123 is connected to the second transverse rod 111. And through the sixth movable corner joint disposed between the fourth supporting rod 115 and the second transverse rod 111, the first housing 121 is connected to the fourth supporting rod 115, and the second housing 123 is connected to the second transverse rod 111.

In the present disclosure, each of the movable corner joints 120 is composed of the first housing 121 and the second housing 123 which rotate with respect to each other, and an rotation angle range of the first housing 121 with respect to the second housing 123 is between 0 degree and 90 degrees, in this way, after each of the transverse rods of the goal frame 100 is connected through two first housings 121 of corresponding two of the movable corner joints 120, and each of the supporting rods of the goal frame 100 is connected through two second housings 123 of corresponding two of the movable corner joints 120, driven by each first housing 121 and each second housing 123, folding angle ranges between each of the transverse rods and each of the supporting rods are also between 0 degree and 90 degrees.

When the goal frame 100 needs to be unfolded, each of the transverse rods and each of the supporting rods of the goal frame 100 rotate through the corresponding movable corner joints 120, so that the first transverse rod 110 is respectively perpendicular to the first supporting rod 112 and the second supporting rod 113 in a vertical direction, the first supporting rod 112 is perpendicular to the third supporting rod 114 in the vertical direction, the second supporting rod 113 is perpendicular to the fourth supporting rod 115 in the vertical direction, and the second transverse rod 111 is respectively perpendicular to the third supporting rod 114 and the fourth supporting rod 115 in a horizontal direction, so as to form a standard goal shape.

When the goal frame 100 needs to be folded, each of the transverse rods and each of the supporting rods of the goal frame 100 rotate through the corresponding movable corner joints 120 to approach each other and abut against each other, which is beneficial to finally folding the goal frame 100 to be in the long strip shape, so that the goal frame 100 is convenient to store and carry.

Further, the first housing 121 and the second housing 123 each includes a first connecting member 125 and a second connecting member 130, the first connecting member 125 is in an elongated shape, the second connecting member 130 is in a circular shape, and both the first connecting member 125 and the second connecting member 130 are internal hollow structures, a first end of the first connecting member 125 is connected to the second connecting member 130, and a second end of the first connecting member 125 distal from the second connecting member 130 defines an opening 126, a rotating shaft 122 is disposed in a middle portion of the second connecting member 130 of the first housing 121, the second connecting member 130 of the second housing 123 defines a rotating shaft 122 hole at a position corresponding to the rotating shaft 122, the rotating shaft 122 is inserted into the rotating shaft 122 hole, so that the second connecting member 130 of the first housing 121 is connected to the second connecting member 130 of the second housing 123.

The first housing 121 and the second housing 123 in the present disclosure are each composed of the first connecting member 125 and the second connecting member 130 as respective main bodies, by using each first connecting member 125 to be in the long strip shape, each first connecting member 125 is more easily adapted to shapes of each of the transverse rods and each of the supporting rods of the goal frame 100, which is convenient for the opening 126 of each first connecting member 125 to be respectively connected to each of the transverse rods and each of the supporting rods. By using each second connecting member 125 to be in the circular shape, after the second connecting member 130 of each first housing 121 is connected to the second connecting member 130 of a corresponding second housing 123, the first housing 121 and the second housing 123 rotate relatively easily.

In the present disclosure, the rotating shaft 122 of the second connecting member 130 of each first housing 121 is inserted into the rotating shaft hole 124 of the second connecting member 130 of the corresponding second housing 123, and the rotating shaft 122 rotates in the rotating shaft hole 124, so that the first housing 121 rotates with respect to the corresponding second housing 123 to realize an overall rotation of each of the movable corner joints 120, so that each of the transverse rods and each of the supporting rods of the goal frame 100 are rotated by corresponding movable corner joints 120 to be folded or unfolded, so that the goal frame 100 may be easily and quickly folded and stored, and the portability of the goal frame 100 is improved.

In addition, a first limiting member 131 is disposed on the second connecting member 130 of the first housing, a second limiting member 133 is disposed at a position of the second connecting member 130 of the second housing corresponding to the first limiting member 131, and the first limiting member 131 is movably connected to the second limiting member 133. The second limiting member 133 includes a first limiting end 134 and a second limiting end 135, when the first housing rotates to be in the first state with respect to the second housing, the first limiting member 131 abuts against the first limiting end 134, and when the first housing rotates to be in the second state with respect to the second housing, the first limiting member 131 abuts against the second limiting end 135.

It should be noted that, the first state mentioned in the present disclosure is that each first housing 121 rotates with respect to the corresponding second housing 123 to a state in which each of the transverse rods and each of the supporting rods are fully unfolded, that is, the standard goal shape 10 is formed. The second state is that each first housing 121 rotates with respect to the corresponding second housing 123 to a state in which each of the transverse rods and each of the supporting rods are fully folded, that is, the goal frame 100 is in a storage state.

The rotation angle range of the first housing 121 with respect to the corresponding second housing 123 may be well controlled through the first limiting piece 131 and the second limiting piece 133, so that each first housing 121 and each second housing 123 drive a corresponding transverse rod and a corresponding supporting rod to rotate to a specified position, so that the goal frame 100 is switched between the first state and the second state, which is beneficial to the goal frame 100 being quickly unfolded to use and quickly folded to store.

Specifically, as shown in FIG. 4, the first connecting member 125 of the first housing 121 and the first connecting member 125 of the second housing 123 are both in tubular shapes, the second connecting member 130 of the first housing 121 and the second connecting member 130 of the second housing 123 are both cylindrical housing structures, the second connecting member 130 of the first housing 121 is embedded in the second connecting member 130 of the second housing 123, and a side wall of the second connecting member 130 of the first housing 121 abuts against a side wall of the second connecting member 130 of the second housing 123. A limiting post 140 is disposed at a position on the second connecting member 130 of the second housing 123 corresponding to the rotating shaft hole 124, the limiting post 140 is a hollow structure, and two ends of the limiting post 140 respectively define two first openings 127, the first openings 127 correspond to the rotating shaft hole 124, and the rotating shaft 122 passes through the rotating shaft hole 124 and extends into the limiting post 140. A torsion spring 141 is sleeved on an outer side of the limiting post 140, the torsion spring 141 includes a first end 142 and a second end 143, the first end 142 is connected to the second connecting member 130 of a corresponding first housing 121, and the second end 143 is connected to the second connecting member 130 of a corresponding second housing 123. The first limiting member 131 includes a first limiting plate 144 disposed on the second connecting member 130 of the first housing 121, the first limiting member 133 includes a limiting housing 150 disposed in the second connecting member 130 of the second housing 123, the first limiting end 134 is a second limiting plate 151 disposed in the limiting housing 150, and the second limiting end 135 is a third limiting plate 152 disposed in the limiting housing 150. When the goal frame 100 is switched from the unfolded state to the folded state, a user needs to apply an external force to each first housing 121 to drive each first housing 121 to rotate with respect to the corresponding second housing 123, since the first end 142 of the torsion spring 141 is connected to the second connecting member 130 of the corresponding first housing 121, the first housing 121 drives the torsion spring 141 to rotate, and the torsion spring 141 is compressed. When the first limiting plate 144 abuts against the second limiting plate 151, the torsion spring 141 is compressed to a maximum compression stroke, and at this time, the goal frame 100 is completely folded. Since the torsion spring 141 has an elastic force, in order to prevent the torsion spring 141 from automatically resetting, the goal frame 100 is automatically unfolded, and after the goal frame 100 is folded, the goal frame 100 needs to be fixed by using the strap, the hook and loop fastener, the storage bag, etc., that is, the goal frame 100 is kept in the folded state only by the external force. When the goal frame 100 needs to be used, only the external force needs to be released, such as unfastening the strap, the hook and loop fastener, etc. At this time, the external force bound to the goal frame 100 disappears, and the torsion spring 141 extends under action of the elastic force, since the first end 142 of the torsion spring 141 is connected to the second connecting member 130 of the corresponding first housing 121, the torsion spring 141 drives the first housing 121 to rotate. When the torsion spring 141 is reset, the goal frame 100 is fully unfolded, and the first limiting plate 144 abuts against the third limiting plate 152. Compared with the prior art, the present disclosure only needs to complete a folding operation of the goal frame 100 when the goal frame 100 needs to be stored, and when the goal frame 100 needs to be used, the goal frame 100 can be automatically unfolded without user operation, which greatly improves convenience of use and is convenient for the user to use.

In the present disclosure, the first connecting member 125 of the first housing 121 and the first connecting member 125 of the second housing 123 are both in tubular shapes, so that after the first connecting member 125 of each first housing 121 and the first connecting member 125 of each second housing 123 are connected to each of the transverse rods and each of the supporting rods of the goal frame 100, ends of each of the transverse rods and ends of each of the supporting rods are wrapped, while each of the ends is protected, structural strength of each of the ends is also increased, so that each of the transverse rods and each of the supporting rods of the goal frame 100 are more stable when being folded or unfolded. And the second connecting member 130 of the first housing 121 and the second connecting member 130 of the second housing 123 are both cylindrical housing structures, and other structures such as the rotating shaft 122 are wrapped inside the first housing 121 and the second housing 123 without being exposed to a surface of the goal frame 100, which is beneficial to improving an overall aesthetic degree of the goal frame 100.

In addition, the limiting post 140 is disposed on the second connecting member 130 of each second housing 123, and when each of the movable corner joints 120 is assembled, the rotating shaft 122 in the second connecting member 130 of each first housing 121 is inserted into a corresponding limiting post 140, so that the rotating shaft 122 may only rotate in the corresponding limiting post 140 to maintain rotation stability of the rotating shaft 122, so that the first housing 121 rotates relatively stably with respect to the second housing 123. Moreover, each torsion spring 141 respectively connected to a corresponding first housing 121 and a corresponding second housing 123 is further sleeved on the outer side of the limiting post 140, and each torsion spring 141 generates torsion in the rotation process of the corresponding first housing 121 and the corresponding second housing 123, so that the goal frame 100 is automatically unfolded, and a specific process is as follows:

When the goal frame 100 is folded, each of the transverse rods and each of the supporting rod of the goal frame 100 rotate through the corresponding movable corner joints 120, in each of the movable corner joints 120, the second connecting member 130 of the first housing 121 rotates with respect to the second connecting member 130 of the second housing 123, so that the torsion spring 141 connected between the second connecting member 130 of the first housing 121 and the second connecting member 130 of the second housing 123 is twisted to compress and deform to generate torsion, after the goal frame 100 is fully folded, the torsion spring 141 is twisted to a maximum torsion state, the first limiting plate 144 of the first housing 121 abuts against the third limiting plate 152 of the limiting housing 150 in the second housing 123, the first housing 121 does not continue to rotate with respect to the second housing 123 to keep the goal frame 100 in the long strip shape, and at this time, the goal frame 100 may be bundled by mounting the hook and loop fastener on an outside of the goal frame 100, so that the goal frame 100 is kept in a contracted and folded state, so that the goal frame 100 is convenient to carry and store.

When the goal frame 100 needs to be unfolded, only the hook and loop fastener on the goal frame 100 needs to be removed, at this time, in each of the movable corner joints 120, the torsion spring 141 connected to the first housing 121 and the second housing 123 release torsion in order to restore deformation, and in a process that the torsion spring 141 releases the torsion, the first housing 121 and the second housing 123 are automatically driven to rotate with respect to each other, so that the corresponding transverse rod and the corresponding supporting rod connected to the first housing 121 and the second housing 123 are unfolded respectively, after the torsion spring 141 completely releases the torsion, the goal frame 100 is completely unfolded, and the first limiting plate 144 of the first housing 121 abuts against the second limiting plate 151 of the limiting housing 150 of the second housing 123, the first housing 121 does not continue to rotate with respect to the second housing 123, so that each of the transverse rods and each of the supporting rods are finally maintained in a form of the goal 10, so that the goal frame 100 is automatically unfolded, which is convenient and quick to use.

Figure 5:
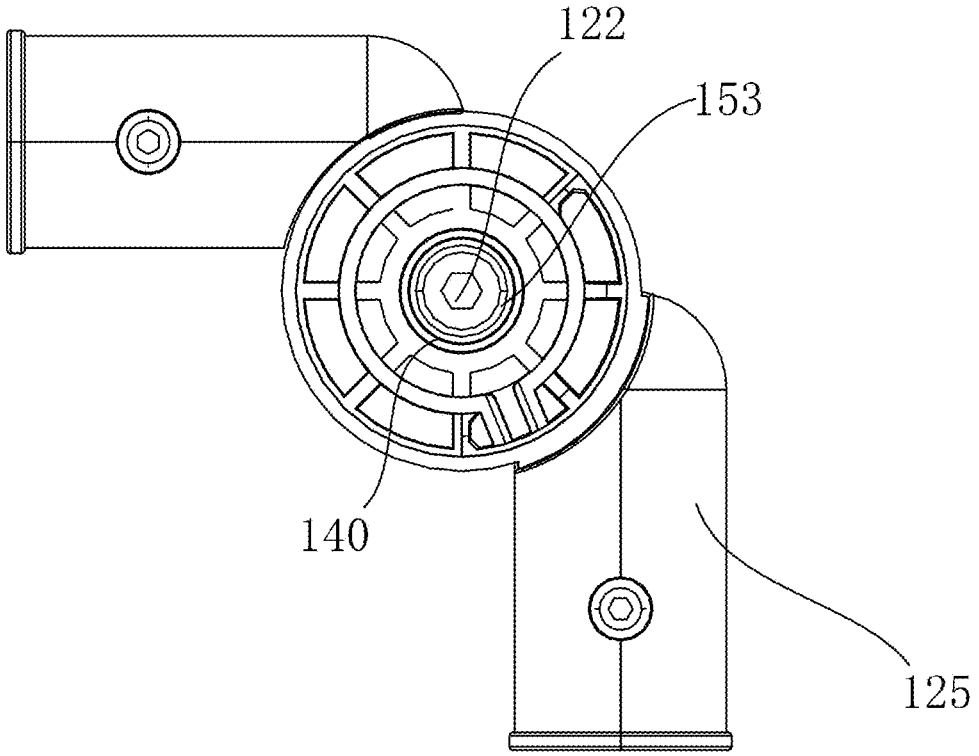
FIG. 5 is a schematic diagram of a movable corner joint of a goal frame according to a second embodiment of the present disclosure.

In order to prevent the goal frame 100 from being automatically unfolded too fast and improve safety of the goal frame 100, the present disclosure further improves a structure of each of the movable corner joints 120, specifically as follows:

FIG. 5 is a schematic diagram of a movable corner joint of a goal frame according to a second embodiment of the present disclosure, the second embodiment shown in FIG. 5 is an improvement based on FIG. 4, a buffer layer 153 is filled between the limiting post 140 and the rotating shaft 122, the buffer layer 153 is made of damping material.

In the present disclosure, the buffer layer 153 is filled between the limiting post 140 and the rotating shaft 122, the buffer layer 153 is may be formed of a damping oil or a damping adhesive. For example, the damping adhesive is filled between the limiting post 140 and the rotating shaft 122, when the first housing 121 and the second housing 123 are unfolded by the torsion spring 141, the torsion spring 141 releases a large torsion at a moment of unfolding, and the first housing 121 is driven to rotate with respect to the second housing 123 during a restoring deformation process, at this time, the rotating shaft 122 of the first housing 121 rotates in the limiting post 140 of the second housing 123, and during a rotating process, the damping adhesive is used for buffering, so as to slow down a rotation speed between the first housing 121 and the second housing 123. When the external force disappears, the goal frame 100 is automatically opened to be in the unfolded state, that is, when the hook and loop fastener for binding the goal frame 100 is untied, as a binding force disappears, the torsion spring 141 after being compressed is restored under the elastic force. In order to avoid a restoring speed of the torsion spring 141 is too fast to cause the goal frame 100 to expand too fast and accidentally hit the user, the buffer layer 153 is filled between the limiting post 140 and the rotating shaft 122 to buffer the elastic force of the torsion spring 141, so that a rotation speed between each of the transverse rods and each of the supporting rods when the goal frame 100 is automatically unfolded is effectively reduced, which is beneficial to improving safety of the goal frame 100.

Figure 6:
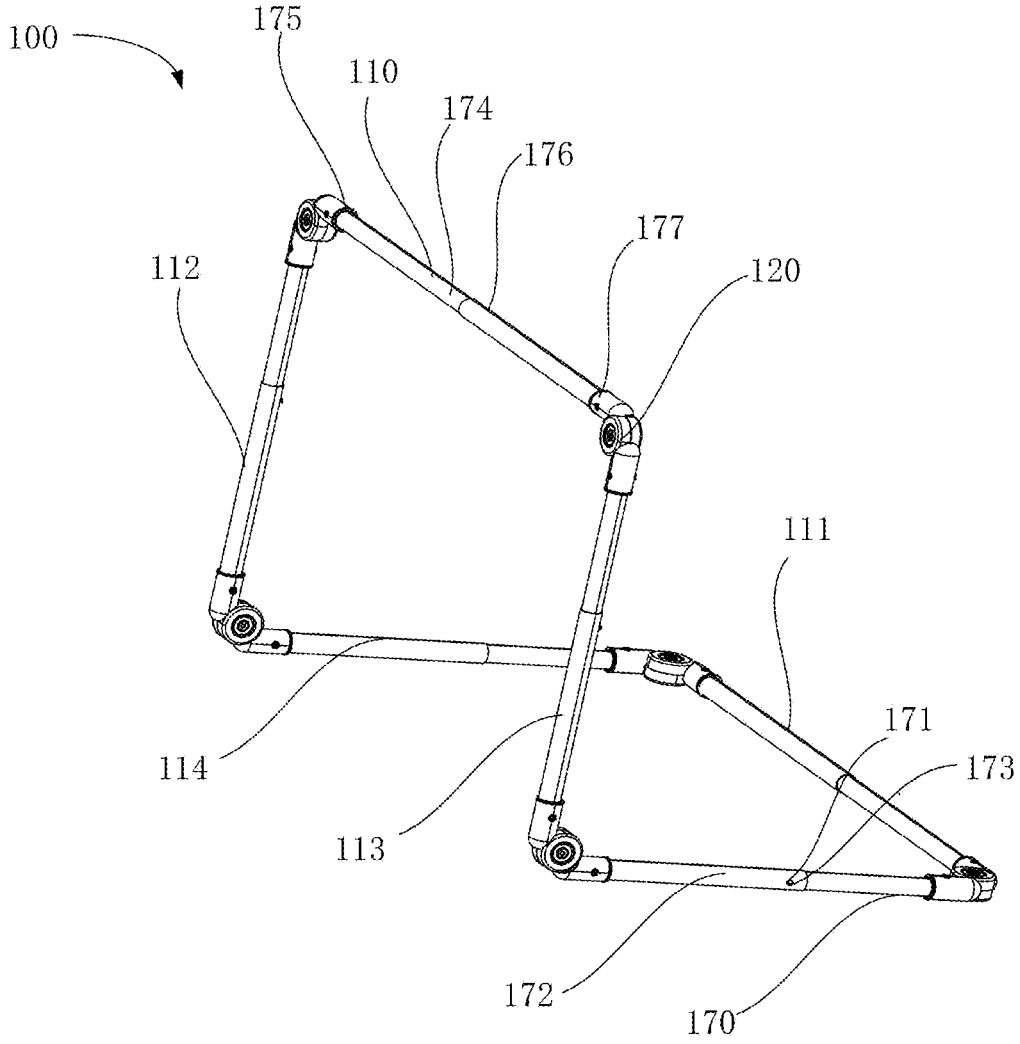
FIG. 6 is a schematic diagram of an unfolded state of a goal frame according to a third embodiment of the present disclosure.
Figure 7:
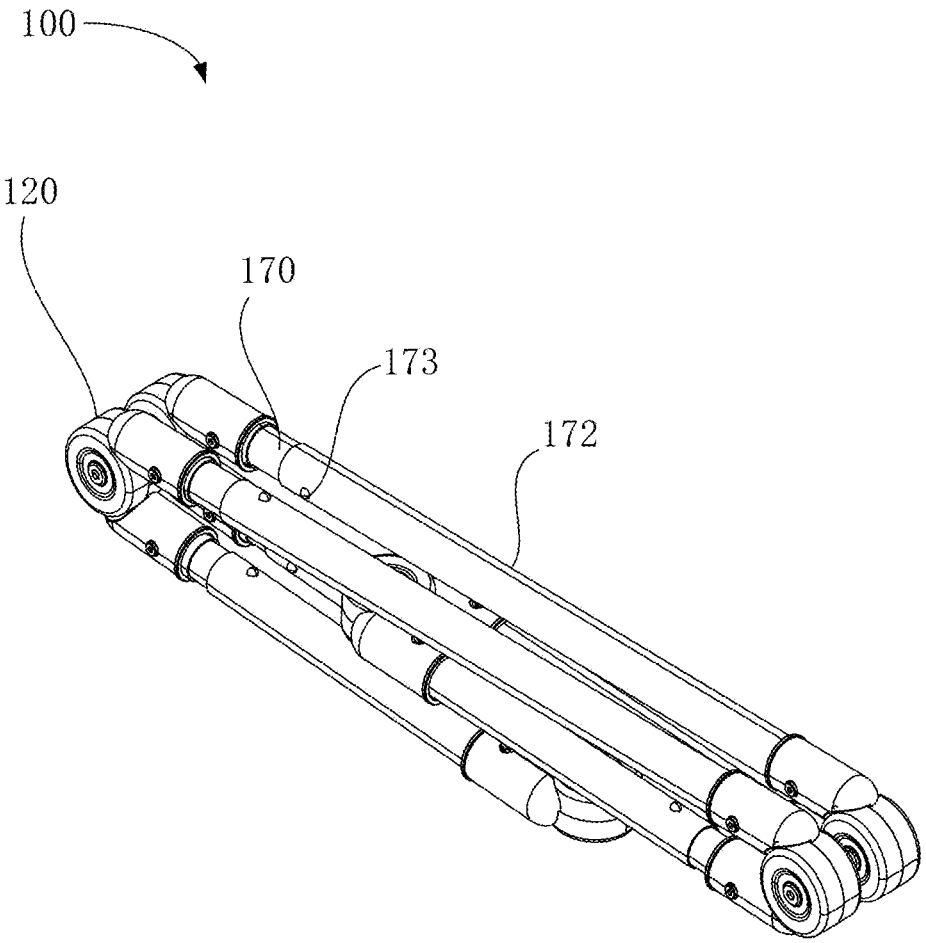
FIG. 7 is a schematic diagram of a folded state of the goal frame according to the third embodiment of the present disclosure.

In addition, in order to further reduce the size of goal frame 100 after being folded, so that the occupied area of the goal frame 100 is further reduced, the goal frame 100 is convenient to store and carry, the present disclosure further improves structures of each of the transverse rods and each of the supporting rods of the goal frame 100, specifically as follows:

FIG. 6 is a schematic diagram of an unfolded state of a goal frame according to a third embodiment of the present disclosure, FIG. 7 is a schematic diagram of a folded state of the goal frame according to the third embodiment of the present disclosure. As shown in FIG. 6 and FIG. 7, the first transverse rod 110, the second transverse rod 111, the first supporting rod 112, the second supporting rod 113, the third supporting rod 114, and the fourth supporting rod 115 each includes a first rod 170 and a second rod 172, and the first rod 170 and the second rod 172 are both hollow structures. The first rod 170 includes a first telescopic end 174 and a first connecting end 175, the second rod 172 includes a second telescopic end 176 and a second connecting end 177, the first telescopic end 174 is close to the second telescopic end 176, and the first connecting end 175 is distal from the second connecting end 177, the first connecting end 175 and the second connecting end 177 are respectively connected to corresponding movable corner joints 120, the first telescopic end 174 is nested in the second rod 172 and extends and retracts along a length direction of the second rod 172. A limiting protrusion 171 is disposed on the first telescopic end 171, the second telescopic end 176 defines a limiting groove 173 at a position corresponding to the limiting protrusion 171, and the limiting protrusion 171 is embedded in the limiting groove 173

In an embodiment, each of the transverse rods and each of the supporting rods of the goal frame 100 are each composed of the first rod 170 and the second rod 172 that extend and retract to each other, the first connecting end 175 and the second connecting end 177 are respectively connected to corresponding movable corner joints 120 for folding between each of the transverse rods and each of the supporting rods. The first telescopic end 174 is embedded into the second rod 172, so that the first rod 170 moves in a length extension direction of the second rod 172 through the first telescopic end 174 to realize extension and retraction between the first rod 170 and the second rod 172, thereby adjusting overall lengths of each of the transverse rods and each of the supporting rods.

When the goal frame 100 needs to be unfolded, only each of the transverse rods and each of the supporting rods need to be rotated by corresponding movable corner joints 120 firstly, so that the goal frame 100 is integrally unfolded. And then, the first rod 170 of each of the transverse rods is pulled out with respect to a corresponding second rod 172, and the first rod 170 of each of the supporting rod is pulled out with respect to a corresponding second rod 172, when the first telescopic end 174 extends outwards to a maximum distance along the length direction of the corresponding second rod 172, the limiting protrusion 171 of the first telescopic end 174 is just embedded into the limiting groove 173 of a corresponding second telescopic end 174, so that the first rod 170 is fixed with respect to the corresponding second rod 172, which is beneficial to enhancing structural stability of the goal frame 100 and finally forming a complete goal frame 100.

When the goal frame 100 needs to be folded, firstly, the limiting protrusion 171 on the first rod 170 is pressed down to separate the limiting protrusion 171 from the limiting groove 173 of the corresponding second rod 172, and then, the first rod 170 is retracted into the second rod 172, thereby effectively shortening lengths of each of the transverse rods and each of the supporting rods, and then each of the transverse rods after being contracted and each of the supporting rods after being contracted are folded in sequence, the size of the goal frame 100 is further reduced in a folding manner, and finally, the goal frame 100 is integrally in the long strip shape. In this way, by two different ways of contracting and folding, the occupied area after the goal frame 100 is folded is reduced, which is convenient for storage and improves portability of the goal 10.

Figure 8:
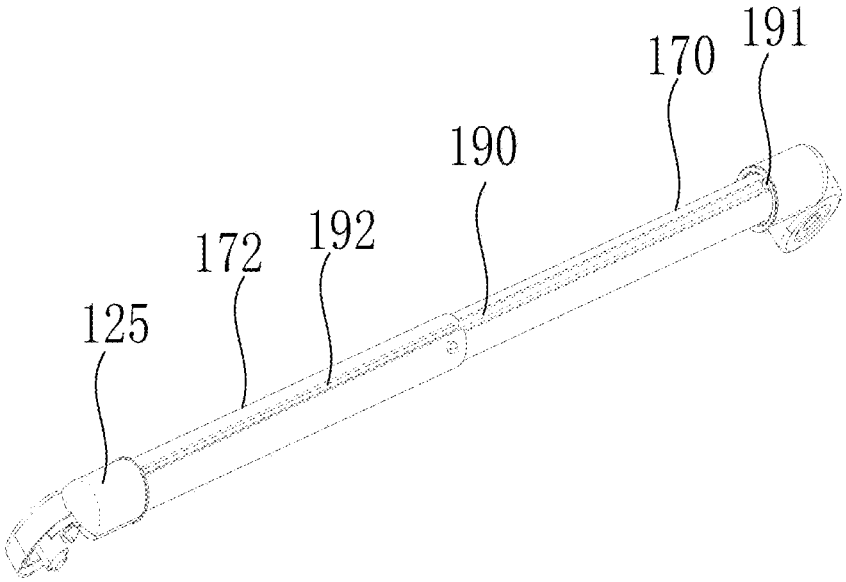
FIG. 8 is a schematic diagram of assembly of a first rod and a second rod of a goal frame according to a fourth embodiment of the present disclosure.
Figure 9:
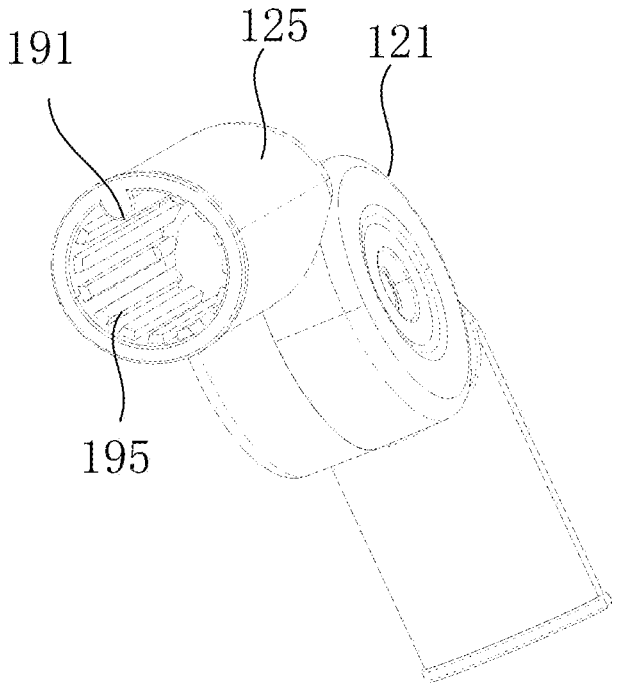
FIG. 9 is a schematic diagram of a first housing of the goal frame according to the fourth embodiment of the present disclosure.
Figure 10:
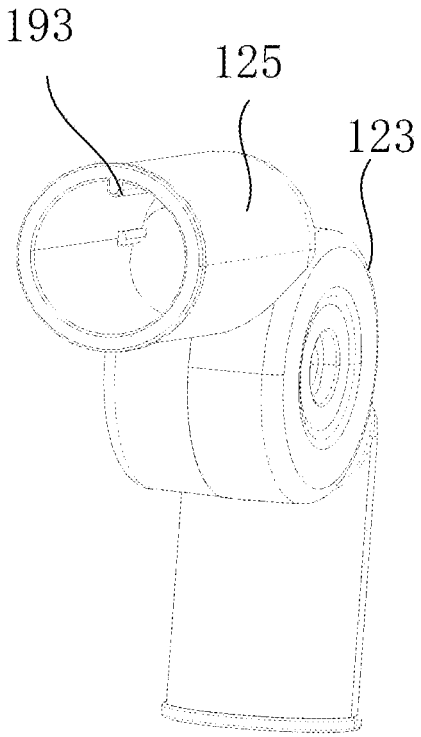
FIG. 10 is a schematic diagram of a second housing of the goal frame according to the fourth embodiment of the present disclosure.

FIG. 8 is a schematic diagram of assembly of a first rod and a second rod of a goal frame according to a fourth embodiment of the present disclosure, FIG. 9 is a schematic diagram of a first housing of the goal frame according to the fourth embodiment of the present disclosure, FIG. 10 is a schematic diagram of a second housing of the goal frame according to the fourth embodiment of the present disclosure. As shown in FIG. 8 and FIG. 10, an end of each first rod 170 is connected to a corresponding first housing 121 of one of the movable corner joints 120, and the second rod 172 is connected to a corresponding second housing 123 of an adjacent one of the movable corner joints 120. An outer surface of the first rod 170 defines first fixing grooves 190, the first fixing grooves 190 are defined at intervals around the outer surface of the first rod 170, and an extending direction of each of the first fixing grooves 190 is the same as an extending direction of the first rod 170. At least one first fixing protruding strip 191 is disposed on the first connecting member 125 of the first housing 121, each first fixing protruding strip 191 is disposed corresponding to one of the first fixing grooves 190, an extending direction of each first fixing protruding strip 191 is the same as an extending direction of the first connecting member 125 of the first housing 121, and each first fixing protruding strip 191 is embedded in one of the first fixing grooves 190. An outer surface of the second rod 172 defines second fixing grooves 192, the second fixing grooves 192 are defined at intervals around the outer surface of the second rod 172, and an extending direction of each of the second fixing grooves 192 is the same as an extending direction of the second rod 172. At least one second fixing protruding strip 193 is disposed on the first connecting member 125 of the second housing 123, each the second fixing protruding strip 193 is disposed corresponding to one of the second fixing grooves 192, an extending direction of each second fixing protruding strip 193 is the same as an extending direction of the first connecting member 125 of the second housing 123, and each second fixing protruding strip 193 is embedded in one of the second fixing grooves 192, positions of the first fixing grooves 190 are in one-to-one correspondence with positions of the second fixing grooves 192, and a width of each of the first fixing grooves 190 is greater than a width of a corresponding second fixing groove 192.

Optionally, reinforcing ribs 195 are further disposed in the first connecting member 125 of the first housing 121, and an extending direction of each of the reinforcing ribs 195 is the same as an extending direction of the first connecting member 125 of the first housing 121, the reinforcing ribs 195 are disposed along an inner circumferential side of the first connecting member 125 of the first housing 121. A rod diameter of the first rod 170 is smaller than a rod diameter of the second rod 172, the first connecting member 125 of the first housing 121 of each of the movable corner joints is connected to the first rod 170, and the first connecting member 125 of the second housing 123 of each of the movable corner joints is connected to the second rod 172. If an inner diameter of the first connecting member 125 of the first housing 121 is the same as an inner diameter of the first connecting member 123 of the second housing, then the first rod 170 may be loosened from the first connecting member of the first housing 121, therefore, in order for the first rod 170 to be better tightened, the reinforcing ribs 195 are disposed on the inner circumferential side of the first connecting member 125, so as to reduce the inner diameter of the first connecting member 125 of the first housing 121, so that the first rod 170 is stably clamped in the first connecting member 125 of the first housing 121. Meanwhile, structural strength of the first connecting member 125 of the first housing 121 is also increased due to an arrangement of the reinforcing ribs 195.

Optionally, adjacent two of the first fixing grooves 190 on each first rod 171 are set to be 90 degrees, and adjacent two of second fixing grooves 192 on each second rod 171 are set to be 90 degrees. Setting to be 90 degrees is defined as assuming that any one of the first fixing grooves 190 rotates by 90 degrees around an axis of the first rod 171 toward another adjacent one of the first fixing grooves, and the adjacent two of first fixing grooves 190 coincide. Similarly, assuming that any one of the second fixing grooves 192 rotates 90 degrees around an axis of the second rod 171 toward another adjacent one of the second fixing grooves, the adjacent two of second fixing grooves 192 coincide. Correspondingly, each first fixing protruding strip 191 is relatively disposed on a side of a corresponding first connecting member 125 of the first housing 121 distal from the second housing 123, each first fixing protruding strip 191 is connected to an outer edge of a corresponding second connecting member 130 of the first housing 121, and each second fixing protruding strip 193 is disposed on a side of a corresponding first connecting member 125 of the second housing 123 distal from the first housing 121. In addition, each first fixing protruding strip 191 and each second fixing protruding strip 192 are rotatably and symmetrically disposed, so that each first rod 170 and each second rod 171 are flexibly assembled with corresponding movable corner joints 120 through corresponding first fixing grooves 190 and corresponding second fixing grooves 192.

Different from the previous embodiment, in this embodiment, the first rod 170 defines first fixing grooves 190, and the second rod 172 defines second fixing grooves 192, at least one first fixing protruding strip 191 is disposed on the first connecting member 125 of each of the movable corner joints 120 connected to the first rod 170, each first fixing protruding strip 191 is disposed corresponding to one of the first fixing grooves 190, at least one second fixing protruding strip 193 is disposed on the first connecting member 125 of each of the movable corner joints 120 connected to the second rod 172, each first fixing protrusion 191 is embedded into a corresponding one of the first fixing grooves 190, and each second fixing protrusion 193 is embedded in a corresponding second fixing groove 192, so that the first rod 170 and the second rod 172 are respectively connected to adjacent two of movable corner joints 120.

In an actual installation process, firstly, the first rod 170 of each of the connecting rods 300 is inserted into the first connecting member 125 of one of the movable corner joints 120 close to the first rod 170, so that each first fixing protruding strip 191 of the first connecting member 125 is inserted into a corresponding first fixing groove 190 of the first rod 170, so that each first fixing protruding strip 191 is limited in the corresponding first fixing groove 190. And then, the second rod 172 of each of the connecting rods 300 is inserted into the first connecting member 125 of one of the movable corner joints 120 close to the second rod 172, so that each second fixing protruding strip 193 of the first connecting member 125 is inserted into a corresponding second fixing groove 192 of the second rod 172, so that each second fixing protruding strip 193 is limited in the corresponding second fixing groove 192, that is, an assembly of each of the connecting rod 300 and two adjacent movable corner joints 120 is completed, in this way, no relative rotation occurs between the first rod 170 and a corresponding one of the movable corner joints 120 connected to the first rod 170, and no relative rotation occurs between the second rod 170 and a corresponding one of the movable corner joints 120 connected to the second rod 172. In addition, due to positions of each first fixing protruding strip 191, each first fixing protruding strip 193, each of the first fixing grooves 190, and each of the second fixing grooves 192 are convenient to observe, which is convenient for the user to install quickly.

Each first fixing groove 190 is disposed corresponding to one of the second fixing grooves 192, and the width of each of the first fixing grooves is greater than the width of the corresponding second fixing groove 192, so that when extending and retracting between the first rod 170 and the second rod 172, a side wall formed by the first fixing groove 190 of the first rod 170 may slide in the corresponding second fixing groove 192 of the second rod 172, so that each of the second fixing grooves 192 forms a rail in which a corresponding first fixing groove 190 slides during a process of stretching and retracting between the first rod 170 and the second rod 172, so as to keep the first rod 170 sliding only in the extending direction of each of the second fixing grooves 192 of the second rod 172, thereby further increasing stability of relative sliding between the first rod 170 and the second rod 172, and further ensuring telescopic stability between the first rod 170 and the second rod 172.

It should be noted that a number and positions of the first fixing grooves 190, a number and positions of the second fixing grooves 192, a number and positions of the first fixing protruding strips 191, and a number and positions of the second fixing protruding strips 193 each may be freely designed according to use conditions of actual users, and the number and the positions are not specifically limited in the present disclosure.

Figure 11:
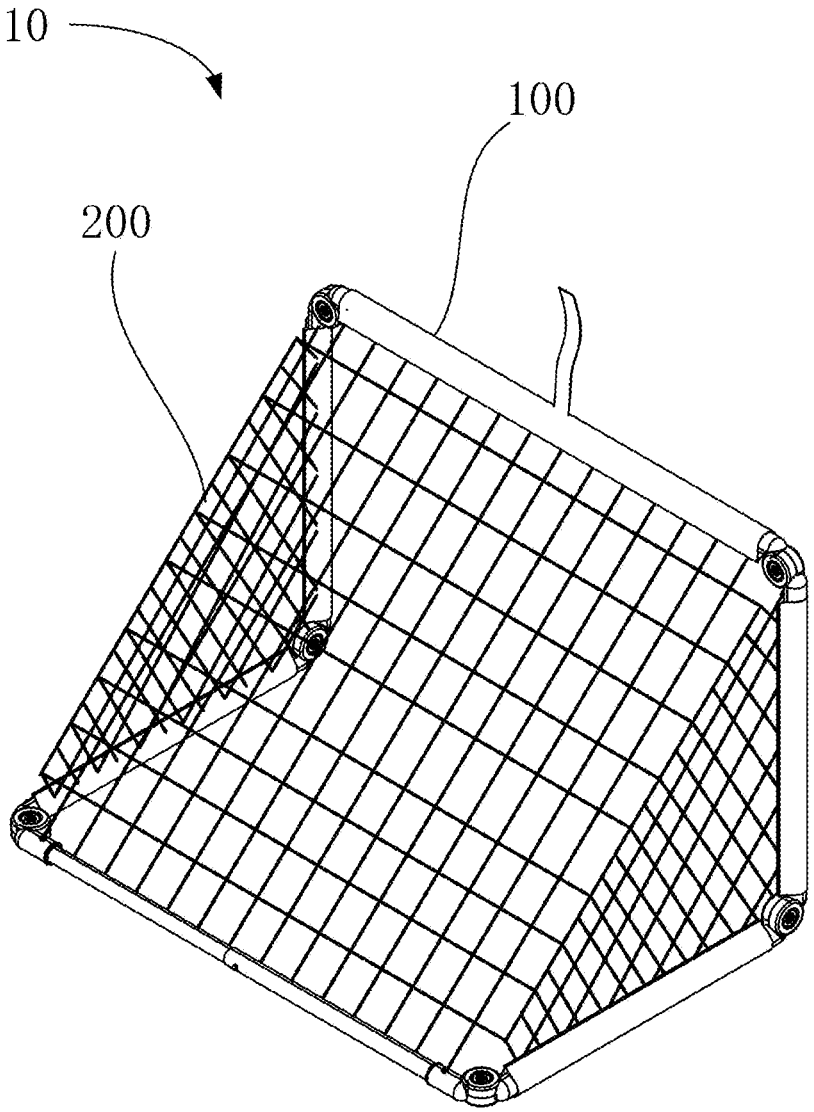
FIG. 11 is a schematic diagram of a goal according to an embodiment of the present disclosure.
Figure 12:
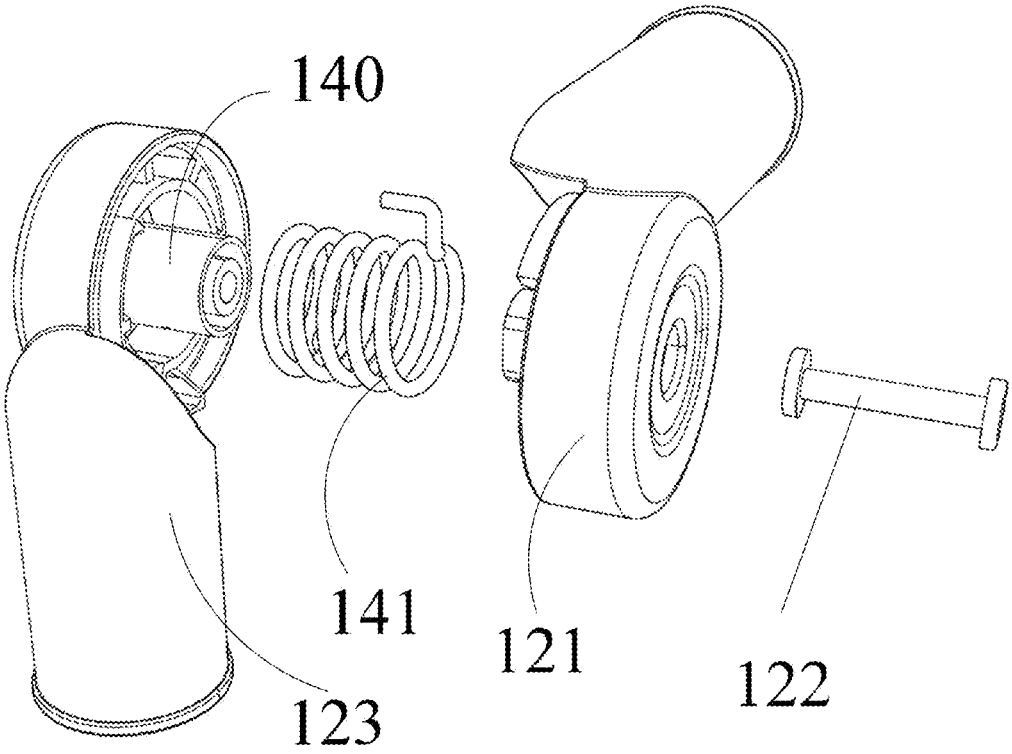
FIG. 12 is an exploded schematic diagram of the movable corner joint of the goal frame according to the first embodiment of the present disclosure.
Figure 13:
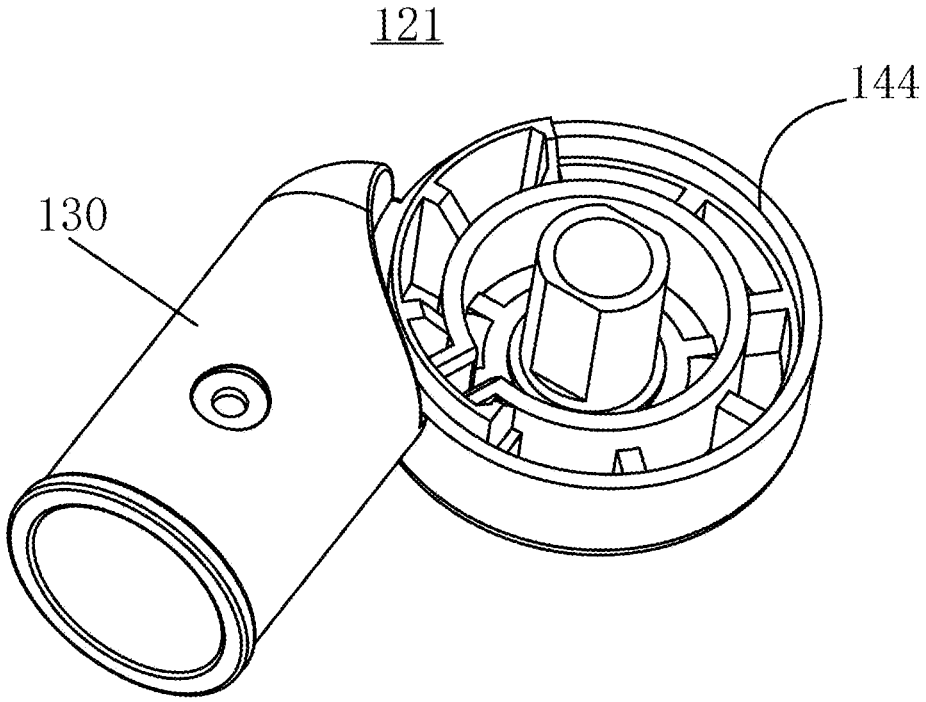
FIG. 13 is a schematic diagram of a first housing of the movable corner joint of the goal frame according to the first embodiment of the present disclosure.
Figure 14:
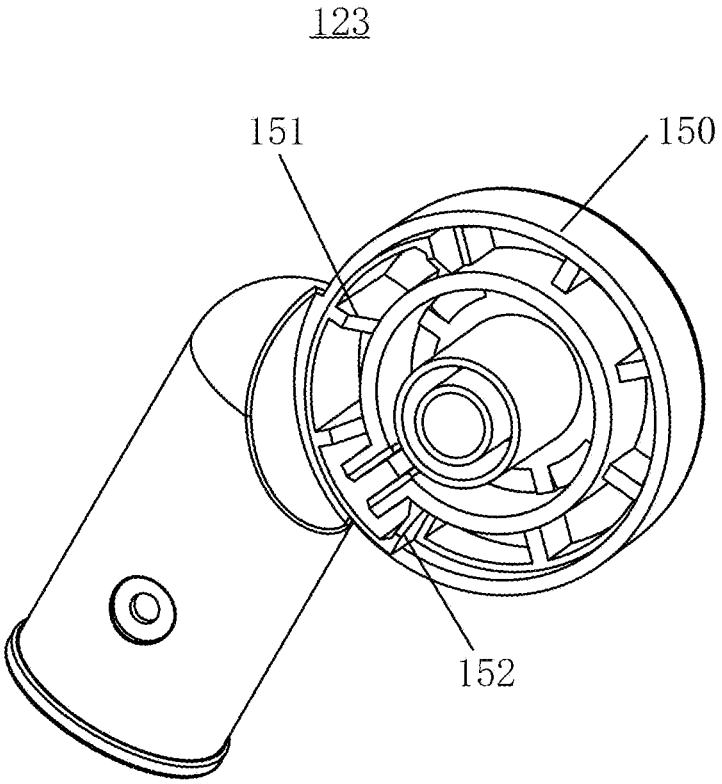
FIG. 14 is a schematic diagram of a second housing of the movable corner joint of the goal frame according to the first embodiment of the present disclosure.

FIG. 11 is a schematic diagram of a goal according to.an embodiment of the present disclosure. As shown in FIG. 11, the present disclosure further provides a goal, including a ball net and the above-mentioned goal frame, the goal frame is connected to the ball net. When the goal frame 100 is unfolded, the ball net 200 is used to prevent a ball entering a range of the goal 10 from continuing to move forward, and the ball is limited within the range of the goal 10, so that the user conveniently re-kicks the ball or recovers the ball.

However, due to outdoor ball sports such as a football, it is often necessary to carry the goal 10, but the goal 10 occupies a large area and is inconvenient to carry.

Based on problems mentioned above, the goal frame 100 of the goal 10 is improved in the present disclosure, corresponding movable corner joints 120 are disposed between each of the transverse rods and each of the supporting rods of the goal frame100, each of the transverse rods and each of the supporting rods are rotatably connected through the corresponding movable corner joints 120, corresponding movable corner joints 120 form similar joint structures between each of the transverse rods and each of the supporting rods, so that each of the transverse rods and each of the supporting rods of the goal frame 100 are freely folded. When the goal frame 100 needs to be folded, the third movable corner joint between the first supporting rod 112 and the third supporting rod 114 and the fourth movable corner joint between the second supporting rod 113 and the fourth supporting rod 115 are first rotated, so that the first supporting rod 112 and the third supporting rod 114 are folded together, and the second supporting rod 113 and the fourth supporting rod 115 are folded together, so that the goal frame 100 is folded in a longitudinal direction, and a size of the goal frame 100 is reduced. And then, the first supporting rod 112 together with the third supporting rod 114, the second supporting rod 113 together with the fourth supporting rod 115 are rotated simultaneously by the first movable corner joint between the first supporting rod 112 and the first transverse rod 110, the second movable corner joint 120 between the second supporting rod 113 and the first transverse rod 110, the fifth movable corner joint between the third supporting rod 114 and the second transverse rod 111, and the sixth movable corner joint 120 between the fourth supporting rod 115 and the second transverse rod 111, so that the first supporting rod 112 and the second supporting rod 113 are folded together with the first transverse rod 110, and the third supporting rod 114 and the fourth supporting rod 115 are folded together with the second transverse rod 111, so that the goal frame 100 is folded again in a transverse direction, and the size of the goal frame 100 is reduced again, the goal frame 100 is integrally in a long strip shape, in this way, the goal frame 100 is quickly folded from multiple directions, the occupied area after the goal frame 100 is folded is effectively reduced, the goal frame 100 is convenient to store and use, and portability of the goal 10 is improved.

In the embodiment mentioned above, each of the movable corner joints 120 includes the first housing 121, the second housing 123, the torsion spring 141, and the damping adhesive. The goal frame 100 is automatically switched from the folded state to the unfolded state under an action of the torsional spring 141, and a damping structure inside each of the movable corner joints enables the goal frame 100 to become stable and slow during the rotating process.

It should be noted that the concept of the present disclosure may form very many embodiments, but amplitude of the disclosure file is limited and may not be listed one by one. Therefore, on the premise that there is no conflict, there may be any combination between the embodiments described above or between the technical features to form a new embodiment, and after each embodiment or technical feature combination, the original technical effect is enhanced.

The above content is a further detailed description of the present disclosure in combination with specific Optionally embodiments, and it cannot be considered that the specific embodiments of the present disclosure is limited to these descriptions. For those of ordinary skill in the art, a number of simple deductions or replacements may also be made without departing from the concept of the present disclosure, all of which should be considered to belong to the protection scope of the present disclosure.

What is claimed is:

1. A goal frame, comprising:

connecting rods; and movable corner joints;

wherein adjacent two of the connecting rods are movably connected through a corresponding one of the movable corner joints, and the connecting rods are connected end to end through the movable corner joints to form the goal frame;

each of the movable corner joints comprises a first housing and a second housing connected to each other, the first housing is rotatable with respect to the second housing within a predetermined angle range, and a connection direction of each adjacent two of the connecting rods is different;

the connecting rods comprise first connecting rods and second connecting rods adjacent to each other, an end of each of the first connecting rods is connected to a corresponding first housing, and an end of each of the second connecting rods close to a corresponding first connecting rod is connected to a corresponding second housing;

the first housing rotates to drive one of the first connecting rods to rotate, so that the goal frame is switched between a first state and a second state;

the first housing and the second housing each comprises a first connecting member and a second connecting member; a first end of the first connecting member is connected to the second connecting member, and a second end of the first connecting member distal from the second connecting member defines an opening;

a rotating shaft is disposed in a middle portion of the second connecting member of the first housing, the second connecting member of the second housing defines a rotating shaft hole at a position corresponding to the rotating shaft, the rotating shaft is inserted into the rotating shaft hole, so that the second connecting member of the first housing is connected to the second connecting member of the second housing;

a limiting post is disposed at a position on the second connecting member of the second housing corresponding to the rotating shaft hole, and the rotating shaft passes through the rotating shaft hole and extends into the limiting post;

a torsion spring is sleeved on an outer side of the limiting post, the torsion spring comprises a first end and a second end, the first end of the torsion spring is connected to the second connecting member of the first housing, and the second end of the torsion spring is connected to the second connecting member of the second housing; the first limiting member comprises a first limiting plate disposed on the second connecting member of the first housing; the second limiting member comprises a limiting housing disposed in the second connecting member of the second housing, the first limiting end is a second limiting plate disposed in the limiting housing, and the second limiting end is a third limiting plate disposed in the limiting housing;

when the goal frame is switched from the second state to the first state, an external force is applied to the first housing to drive the first housing to rotate with respect to the second housing, the torsion spring is compressed, and the first limiting plate abuts against the second limiting plate;

when the external force disappears, the torsion spring relaxes under an elastic force and drives the first housing to rotate with respect to the second housing, and the first limiting plate abuts against the third limiting plate, so that the goal frame is automatically switched from the first state to the second state.

2. The goal frame according to claim 1, wherein a first limiting member is disposed on the second connecting member of the first housing, a second limiting member is disposed at a position of the second connecting member of the second housing corresponding to the first limiting member, and the first limiting member is movably connected to the second limiting member;

the second limiting member comprises a first limiting end and a second limiting end; when the first housing rotates to be in the first state with respect to the second housing, the first limiting member abuts against the first limiting end, and when the first housing rotates to be in the second state with respect to the second housing, the first limiting member abuts against the second limiting end.

3. The goal frame according to claim 2, wherein the first connecting member of the first housing and the first connecting member of the second housing are both in tubular shapes; the second connecting member of the first housing and the second connecting member of the second housing are both cylindrical housing structures, the second connecting member of the first housing is embedded in the second connecting member of the second housing, and a side wall of the second connecting member of the first housing abuts against a side wall of the second connecting member of the second housing; the limiting post is a hollow structure, and two ends of the limiting post respectively define two first openings, and the first openings correspond to the rotating shaft hole;

a buffer layer is filled between the limiting post and the rotating shaft, the buffer layer is made of a damping material, and the buffer layer is configured to buffer the elastic force of the torsion spring.

4. The goal frame according to claim 1, wherein the first connecting rods comprise a first transverse rod, a third supporting rod, and a fourth supporting rod, and the second connecting rods comprise a second transverse rod, a first supporting rod, and a second supporting rod;

two ends of the first transverse rod are respectively connected to an end of the first supporting rod and an end of the second supporting rod, an end of the first supporting rod distal from the first transverse rod is connected to an end of the third supporting rod, an end of the second supporting rod distal from the first transverse rod is connected to an end of the fourth supporting rod, and an end of the third supporting rod distal from the first supporting rod and an end of the fourth supporting rod distal from the second supporting rod are respectively connected to the second transverse rod; the movable corner joints comprise a first movable corner joint, a second movable corner joint, a third movable corner joint, a fourth movable corner joint, a fifth movable corner joint, and a sixth movable corner joint; the first movable corner joint is connected between ends of the first transverse rod and the first supporting rod, the second movable corner joint is connected between ends of the first transverse rod and the second supporting rod, the third movable corner joint is connected between ends of the first supporting rod and the third supporting rod, the fourth movable corner joint is connected between ends of the second supporting rod and the fourth supporting rod, the fifth movable corner joint is connected between ends of the second transverse rod and the third supporting rod, and the sixth movable corner joint is connected between ends of the second transverse rod and the fourth supporting rod;

the first movable corner joint between the first transverse rod and the first supporting rod and the second movable corner joint between the first transverse rod and the second supporting rod respectively drive the first supporting rod and the second supporting rod to rotate toward a direction of the first transverse rod, and the first supporting rod and the second supporting rod are respectively folded with respect to the first transverse rod; the third movable corner joint between the first supporting rod and the third supporting rod drives the third supporting rod to rotate toward a direction of the first supporting rod, and the third supporting rod is folded with respect to the first supporting rod; the fourth movable corner joint between the second supporting rod and the fourth supporting rod drives the fourth supporting rod to rotate toward a direction of the second supporting rod, and the fourth supporting rod is folded with respect to the second supporting rod; the fifth movable corner joint between the second transverse rod and the third supporting rod and the sixth movable corner joint between the second transverse rod and the fourth supporting rod respectively drive the third supporting rod and the fourth supporting rod to rotate toward a direction of the second transverse, and the third supporting rod and the fourth supporting rod are respectively folded with respect to the second transverse rod.

5. The goal frame according to claim 4, wherein the first transverse rod, the second transverse rod, the first supporting rod, the second supporting rod, the third supporting rod, and the fourth supporting rod each comprises a first rod and a second rod, and the first rod and the second rod are both hollow structures;

the first rod comprises a first telescopic end and a first connecting end, the second rod comprises a second telescopic end and a second connecting end, the first telescopic end is close to the second telescopic end, and the first connecting end is distal from the second connecting end; the first connecting end and the second connecting end are respectively connected to corresponding movable corner joints, the first telescopic end is nested in the second rod and extends and retracts along a length direction of the second rod; a limiting protrusion is disposed on the first telescopic end, the second telescopic end defines a limiting groove at a position corresponding to the limiting protrusion, and the limiting protrusion is embedded in the limiting groove.

6. The goal frame according to claim 5, wherein an end of each first rod is connected to a corresponding first housing of one of the movable corner joints, and the second rod is connected to a corresponding second housing of an adjacent one of the movable corner joints; an outer surface of the first rod defines first fixing grooves, the first fixing grooves are defined at intervals around the outer surface of the first rod, and an extending direction of each of the first fixing grooves is the same as an extending direction of the first rod; at least one first fixing protruding strip is disposed on the first connecting member of the first housing, each first fixing protruding strip is disposed corresponding to one of the first fixing grooves, an extending direction of each first fixing protruding strip is the same as an extending direction of the first connecting member of the first housing, and each first fixing protruding strip is embedded in one of the first fixing grooves;

an outer surface of the second rod defines second fixing grooves, the second fixing grooves are defined at intervals around the outer surface of the second rod, and an extending direction of each of the second fixing grooves is the same as an extending direction of the second rod; at least one second fixing protruding strip is disposed on the first connecting member of the second housing, each second fixing protruding strip is disposed corresponding to one of the second fixing grooves, an extending direction of each second fixing protruding strip is the same as an extending direction of the first connecting member of the second housing, and the-each second fixing protruding strip is embedded in one of the second fixing grooves;

positions of the first fixing grooves are in one-to-one correspondence with positions of the second fixing grooves, and a width of each of the first fixing grooves is greater than a width of a corresponding second fixing groove.

7. The goal frame according to claim 6, wherein reinforcing ribs are further disposed in the first connecting member of the first housing, the reinforcing ribs are disposed along a circumferential direction of the first connecting member of the first housing, so that an inner diameter of the first connecting member of the first housing is smaller than an inner diameter of the first connecting member of the second housing.

8. A goal, comprising:

the goal frame according to claim 1; and a ball net, wherein the goal frame is connected to the ball net.

9. A goal frame, comprising:

connecting rods; and movable corner joints;

wherein adjacent two of the connecting rods are movably connected through a corresponding one of the movable corner joints, and the connecting rods are connected end to end through the movable corner joints to form the goal frame;

each of the movable corner joints comprises a first housing and a second housing connected to each other, the first housing is rotatable with respect to the second housing within a predetermined angle range, and a connection direction of each adjacent two of the connecting rods is different;

the connecting rods comprise first connecting rods and second connecting rods adjacent to each other, an end of each of the first connecting rods is connected to a corresponding first housing, and an end of each of the second connecting rods close to a corresponding first connecting rod is connected to a corresponding second housing;

the first housing rotates to drive one of the first connecting rods to rotate, so that the goal frame is switched between a first state and a second state;

the first connecting rods and the second connecting rods each comprises a first rod and a second rod, an end of each first rod is connected to a corresponding first housing of one of the movable corner joints, and the second rod is connected to a corresponding second housing of an adjacent one of the movable corner joints; an outer surface of the first rod defines first fixing grooves, the first fixing grooves are defined at intervals around the outer surface of the first rod, and an extending direction of each of the first fixing grooves is the same as an extending direction of the first rod; at least one first fixing protruding strip is disposed on the first connecting member of the first housing, each first fixing protruding strip is disposed corresponding to one of the first fixing grooves, an extending direction of each first fixing protruding strip is the same as an extending direction of the first connecting member of the first housing, and each first fixing protruding strip is embedded in one of the first fixing grooves;

an outer surface of the second rod defines second fixing grooves, the second fixing grooves are defined at intervals around the outer surface of the second rod, and an extending direction of each of the second fixing grooves is the same as an extending direction of the second rod; at least one second fixing protruding strip is disposed on the first connecting member of the second housing, each second fixing protruding strip is disposed corresponding to one of the second fixing grooves, an extending direction of each second fixing protruding strip is the same as an extending direction of the first connecting member of the second housing, and each second fixing protruding strip is embedded in one of the second fixing grooves;

positions of the first fixing grooves are in one-to-one correspondence with positions of the second fixing grooves, and a width of each of the first fixing grooves is greater than a width of a corresponding second fixing groove.

* * * * *